US007223919B2

(12) United States Patent
Gagne

(10) Patent No.: US 7,223,919 B2
(45) Date of Patent: May 29, 2007

(54) FLAT FLEXIBLE CABLE WITH INTEGRATED STIFFENER

(76) Inventor: Norman P. Gagne, 855 Coral Ave., Manchester, NH (US) 03104

( * ) Notice: Subject to any disclaimer, the term of this patent is extended or adjusted under 35 U.S.C. 154(b) by 0 days.

(21) Appl. No.: 10/843,112

(22) Filed: May 11, 2004

(65) Prior Publication Data

US 2005/0252677 A1 Nov. 17, 2005

(51) Int. Cl.
*H01B 7/00* (2006.01)

(52) U.S. Cl. ..... 174/117 F; 174/36

(58) Field of Classification Search ..... 174/110 R, 174/113 R, 117 R, 117 F, 117 FF
See application file for complete search history.

(56) References Cited

U.S. PATENT DOCUMENTS

| | | | | | |
|---|---|---|---|---|---|
| 3,997,229 | A * | 12/1976 | Narozny et al. | 439/492 |
| 4,375,379 | A * | 3/1983 | Luetzow | 156/52 |
| 4,381,420 | A * | 4/1983 | Elliott et al. | 174/34 |
| 4,778,403 | A | 10/1988 | Ikesugi et al. | 439/329 |
| 4,864,081 | A * | 9/1989 | Bates | 174/88 R |
| 5,281,765 | A * | 1/1994 | Iura et al. | 174/117 F |
| 5,389,741 | A * | 2/1995 | Ueno | 174/117 F |
| 5,481,894 | A | 1/1996 | Saen et al. | 72/200 |
| 5,483,021 | A | 1/1996 | Saen et al. | 174/117 |
| 5,814,769 | A * | 9/1998 | Karlstrom et al. | 174/117 F |
| 5,834,701 | A | 11/1998 | Saka et al. | 174/117 |
| 5,939,952 | A | 8/1999 | Noda et al. | 333/1 |
| 5,942,905 | A | 8/1999 | Balyasny | 324/755 |
| 5,954,537 | A | 9/1999 | Sonobe et al. | 439/495 |
| 6,020,559 | A * | 2/2000 | Maeda | 174/117 F |
| 6,161,894 | A | 12/2000 | Chapman | 296/155 |
| 6,210,210 | B1 | 4/2001 | Kozel et al. | 439/495 |
| 6,478,597 | B1 | 11/2002 | Roberts et al. | 439/260 |
| 6,521,838 | B2 * | 2/2003 | Yamanobe et al. | 174/117 F |
| 6,552,272 | B1 | 4/2003 | Sheng et al. | 174/117 |
| 6,585,836 | B2 | 7/2003 | Inagaki et al. | 156/55 |
| 6,586,681 | B2 | 7/2003 | Adams et al. | 174/117 |
| 2002/0170740 | A1 | 11/2002 | Yamanobe et al. | 174/117 |
| 2003/0045146 | A1 * | 3/2003 | Sugata | 439/154 |
| 2003/0075353 | A1 | 4/2003 | Sheng et al. | 174/117 |
| 2003/0082941 | A1 * | 5/2003 | Kuller et al. | 439/160 |
| 2004/0031619 | A1 * | 2/2004 | Lettmann et al. | 174/117 F |

FOREIGN PATENT DOCUMENTS

JP 2002-237343 A * 8/2002

* cited by examiner

*Primary Examiner*—William H. Mayo, III
(74) *Attorney, Agent, or Firm*—Grossman, Tucker, Perreault & Pfleger, PLLC

(57) ABSTRACT

A flat flexible cable having conductive pathways laminated between a top and a bottom insulating layer and including an integrated stiffening element. The integrated stiffening element is laminated in between one of the top and bottom insulating layers and the conductive pathways. Integrating the stiffening element into the flat flexible cable in this manner allows the stiffening element to resist peeling or other removal from the remainder of the flat flexible cable.

20 Claims, 2 Drawing Sheets

FLAT FLEXIBLE CABLE WITH INTEGRATED STIFFENER

TECHNICAL FIELD

The present application generally relates generally to flat flexible cable.

BACKGROUND

Flat flexible cable is commonly used for connecting electrical devices. Flat flexible cable may provide a structure including multiple conductive pathways and may be easily and reversibly bent and twisted in a narrow and crowded space. Various advantages may be provided by flat flexible cable as compared to other cable types. For example, using rectangular conductors as conductive pathways may allow greater amounts of current to be transferred at equal cross-sectional area in comparison with round conductors. This may allow a weight reduction and a reduction in space required for the cable. These advantages have found particular utility in the electronics and automotive industries. The flat configuration of flat flexible cable also allows this type of cable to be mounted behind coverings with limited design depth. Because of these advantages, flexible flat cable is being used to an increasing degree in automobile manufacture as a replacement for cable consisting of round conductors.

Flat flexible cable may generally be provided as a laminated structure or an extruded structure. As a laminated structure, flat flexible cable may generally include a plurality of parallel conductors laminated between opposed insulating sheets or strips. Laminated electrical flat conductors may generally be provided as individual conductors in spool form. The individual conductors may be arranged into a conductor set during the process of lamination using slotted guides. The conductor set consists of individual conductive pathways. The individual conductive pathways may be individually insulated from each other, i.e., arranged at a spacing relative to each other and have a rectangular cross section. The tops of the conductive pathways may be electrically insulated, for example by an insulating sheet, which is laminated onto the conductive pathways. Similarly, a bottom insulator may also be laminated onto the bottom of the conductive pathways. The top insulator and bottom insulator may be laminated together in the regions between adjacent conductive pathways and on the edges outside of the conductive pathways.

Extruded flat flexible cable may be formed by conductive pathways in an insulating sheath by an extrusion process with an electrically insulating plastic sheath. The plurality of conductors may pass through an extrusion die, such as a wire coating, cross-head extrusion die with the conductors maintained in a desired spaced-apart and parallel arrangement. The resultant flat flexible cable may, therefore, include a plurality of conductive pathways that are electrically isolated, but encased in a unitary sheathing. The shape and properties of the finished extruded flat flexible cable may correspond at least essentially to the shape and properties of a laminated flat flexible cable and the sheathing material.

BRIEF DESCRIPTION OF DRAWINGS

Features and advantages of the claimed subject matter will be apparent from the following description of embodiments consistent therewith, which description should be considered in conjunction with the accompanying drawings, wherein:

DETAILED DESCRIPTION

Figure 1:
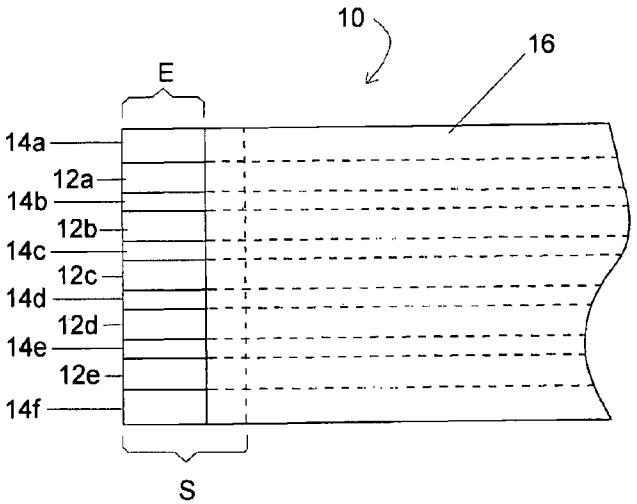
FIG. 1 illustrates an embodiment of a flat flexible cable in plan view.

Referring to FIG. 1, an end portion of an embodiment of a flat flexible cable 10 is shown in plan view. In the illustrated embodiment, the flat flexible cable 10 is shown including a plurality of conductive pathways 12*a–e* that may extend generally parallel to one another. It should be noted that while five conductive pathways 12*a–e* are illustrated, the flat flexible cable 10 may include greater of fewer conductive pathways. The plurality of conductive pathways 12*a–e* may be separated across the width of the flat flexible cable 10 by a plurality of respective insulating partitions 14*b–e*. The two outer conductive pathways 12*a* and 12*e* may be insulated on the outside edges thereof by respective insulating partitions 14*a* and 14*f*. With additional reference to FIG. 3, the flat flexible cable 10 may also include a top insulating layer 16 and a bottom insulating layer 18, thereby electrically isolating the conductive pathways on the upper and lower surfaces thereof.

Consistent with the present disclosure, the plurality of conductive pathways 12*a–e* may each be a flexible conductive foil or wire. The conductive foil or wire may include a metallic material, or a conductive or semi-conductive material, for example a conductive polymer, like polyacetylene, or polymer filled with a conductive filler, such as silver. According to one embodiment, each of the plurality of conductive pathways 12*a–e* may include a copper foil, although, as previously mentioned, other conductive materials may suitable be employed herein. Additionally, while the plurality of conductive pathways 12*a–e* are shown as being generally similarly dimensioned this is not a necessary feature. For example, one or more of the conductive pathways 12*a–e* may have a larger or smaller cross-sectional area to suit specific current capacities, etc.

The top and bottom insulating layers 16, 18 of the flat flexible cable 10 may be formed from any electrically insulating film, sheet, or coating. According to one embodiment, the top and bottom insulating layers 16, 18 may be formed from a polymeric sheet or film. Examples of suitable polymeric films or sheets may include polyester film, for example biaxially oriented polyester film available from E. I. du Pont de Nemours and Company under the name Mylar®, polyamide film, as well as numerous other polymeric film and sheet materials. The top and bottom insulating layers 16, 18 may be formed from the same material. Alternatively, the top and bottom insulating layers 16, 18 may be formed from different materials. Additionally, the top and bottom insulating layers 16, 18 may be provided having the same thickness as one another, but may alternatively be provided having different thicknesses.

Figure 3:
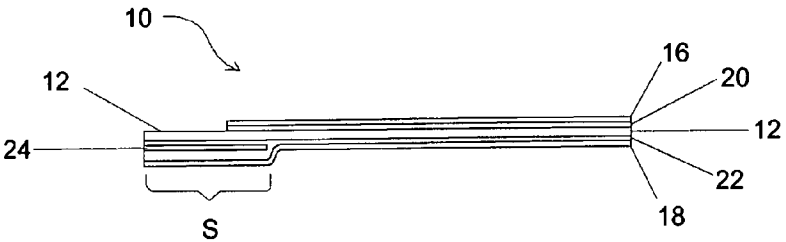
FIG. 3 shows the embodiment of the flat flexible cable of FIG. 1 from a side elevation.
Figure 4:
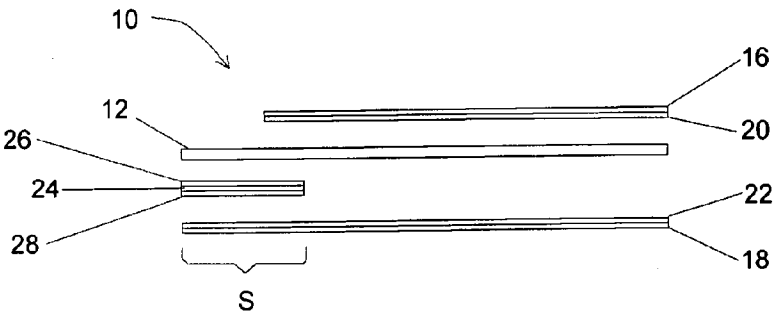
FIG. 4 is a side elevation exploded view of the flat flexible cable of FIG. 1.

As most clearly shown in FIG. 3, the conductive pathways, generally indicated by 12, as well as the bottom insulating layer 18, may extend beyond the top conductive layer 16, thereby providing an exposed region E of the conductive pathways 12. The exposed region E may facilitate electrical coupling between the flat flexible cable 10 and a mating connector (not shown) or other device. For example, the flat flexible cable 10 may be electrically coupled with a connector, such as a zero insertion force (ZIF) connector, which may have a plurality of electrical contacts positioned to provide electrical connection with the respective conductive pathways 12*a–e* in the exposed region E of the conductive pathways 12. Consistent with an embodiment herein, each end of the flat flexible cable 10 may include an exposed region E, allowing each end of the flat flexible cable 10 to be electrically coupled to a connector as generally described above. In an embodiment in which each end of the flat flexible cable 10 is provided with an exposed region E, the exposed regions may be provided on the same side of the flat flexible cable 10, or may be provided on opposed sides of the flat flexible cable 10. Alternative arrangements for electrically coupling the flat flexible cable 10 may be utilized herein. According to alternative arrangements, one, or both, ends of the flat flexible cable 10 may be provided without an exposed region E or the conductive pathways 12.

A flat flexible cable 10 consistent with the present disclosure may also include a stiffening element 24. In the illustrated embodiment the stiffening element 24 is disposed in a stiffened region S, located at an end of the flat flexible cable 10. The stiffening element 24 may be a member extending across at least a portion of the width of the flat flexible cable 10. In one embodiment, the stiffening element 24 may extend across the entire width of the flat flexible cable 10.

Figure 2:
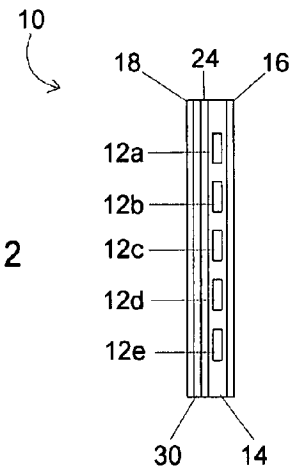
FIG. 2 is an end view of the flat flexible cable shown in FIG. 1.

As best shown in FIGS. 2 and 3, the stiffening element 24 may be disposed between an outer insulating layer, such as the bottom insulating layer 18, and the conductive pathways 12. Accordingly, as shown in FIG. 3, the stiffening member 24 may be integrated into the structure of the flat flexible cable 10. Integrating the stiffening member 24 into the structure of the flat flexible cable 10 may, to some degree, prevent the stiffening member from becoming inadvertently separated, e.g. peeled, from the remainder of the flat flexible cable 10. For example, in the illustrated embodiment, the bottom insulating layer 18 may be stepped over the stiffening element 24, thereby providing a continuous bottom surface to the flexible flat cable 10 and covering the rearward edge of the stiffening element 24. The incorporated stiffening element 24 and the continuous bottom surface may prevent the stiffening element 24 from inadvertently separating form the flexible flat cable 10, at least in part, by eliminating the exposure of the free rearward edge of the stiffening element 24 to possible snagging or peeling action.

Consistent with the present disclosure, stiffening member 24 may be formed from any suitable material. According to one embodiment, the stiffening member 24 may be formed from a polymeric material. For example, the stiffening member 24 may be formed from the same material as the top and bottom insulating layers 16, 18. Accordingly, the stiffening member 24 may be formed from, for example, a polymeric sheet or film such as polyester, polyamide, etc. It is not necessary, however, for the stiffening member 24 to be formed from the same material as either or both of the insulating layers 16, 18. Furthermore, it is contemplated herein that the stiffening element 24 may be a composite structure including two or more materials. In an embodiment employing a composite stiffening element 24, the two or more materials may be provided as a mixed structure, a layered structure, etc.

According to one embodiment the stiffening element 24 may be provided to increase the flexural modulus of a region S of the flat flexible cable 10. The length of the region S may be established by the length of the stiffening element, and may depend on the application for the associated cable. Those skilled in the art will recognize that flat flexible cables may be provided in a variety of dimensions. In one embodiment, where the cable has a width of about 1.1875", the stiffening element may extend completely or partially across the width of the cable and have a length of about 0.1875."

The increase in the flexural modulus, or stiffness, of the region S of the flat flexible cable 10 may be a function of a number of characteristics. For example, a more rigid stiffening element 24 may impart a greater stiffness or rigidity on the region S of the flat flexible cable 10 including the stiffening element 24, as compared to a less stiff or rigid stiffening element 24. The stiffness or rigidity of the stiffening element 24 may be, at least in part, a function of the mechanical properties of the material used to form the stiffening element 24. The stiffness of the region S of the flat flexible cable 10 including the stiffening element 24 may also be a function of the thickness of the stiffening element 24. Generally, a thicker cross-section of a given material may be more rigid than a thinner cross section of the same material. Additionally, a thicker stiffening element 24 may increase the moment of inertia of the region of the flat flexible cable 10 including the stiffening element 24.

Consistent with the foregoing, the stiffening element 24 may be used to increase the flexural modulus, or stiffness, of the region S of the flat flexible cable 10 including the stiffening element. According to one embodiment, the stiffening element 24 may be provided at an end of the flat flexible cable 10, thereby increasing the stiffness of the end of the cable 10. Increasing the stiffness of an end of the flat flexible cable 10 may be useful for facilitating the insertion of the end of the flat flexible cable 10 into a connector. The increased stiffness of the end of the flat flexible cable 10 may allow the necessary insertion force to be generated at the end of the flat flexible cable 10 being inserted into a connector without the buckling or bending the cable 10. Stiffening the end of a flat flexible cable 10 may also be useful even when the cable 10 is being used in combination with a connector requiring minimal insertion force, such as a ZIF connector. Increasing the stiffness of the flat flexible cable 10 may increase the ability to orient and/or position the end of the flat flexible cable 10 in a desired manner in order to achieve an electrical connection between a connector and the flat flexible cable 10. Increasing the stiffness of a region S of the flat flexible cable 10 may be used to provide other advantages as well. While the stiffening element 24 is disposed at an end of the flat flexible cable 10 in the illustrated embodiments, the stiffening member may be disposed at any location along the length of the flat flexible cable 10. Furthermore, while the stiffening element 24 is oriented generally transverse to the longitudinal axis of the flat flexible cable 10, the stiffening element 24 may be disposed in other relationships to the longitudinal axis of the flat flexible cable 10.

A stiffening element 24 herein may also, or alternatively, be used to achieve a desired thickness for a region S of a flat flexible cable 10 including the stiffening element 24. For example, a connector may require a specific thickness of a mating flat flexible cable 10 in order to generate a desired contact force between an electrical contact of a connector and the conductive pathways 12*a–e* of the flat flexible cable 10. Similarly, a predetermined thickness may be necessary to generate a desired holding force between the flat flexible cable 10 and a retention feature of the connector. To these ends, the stiffening element 24 may be provided to increase the thickness of the region S of the flat flexible cable 10 including the stiffening element 24 to a desired thickness, or range of thicknesses. Additionally, when the stiffening element 24 is to be used, at least in part, to provide a desired thickness to generate a contact or retention pressure with a cooperating element, the stiffening element 24 may be provided from a material that may be at least somewhat compressible. According to one embodiment, a stiffening element 24 may be provided from a material that is resiliently compressible. Consistent with such an embodiment, a contact force between a flat flexible cable 10 and a cooperating element may include a component related to the spring constant of the resiliently compressible stiffening element 24, as well as the insulating layers 16, 18, etc. of the cable 10.

Figure 5:
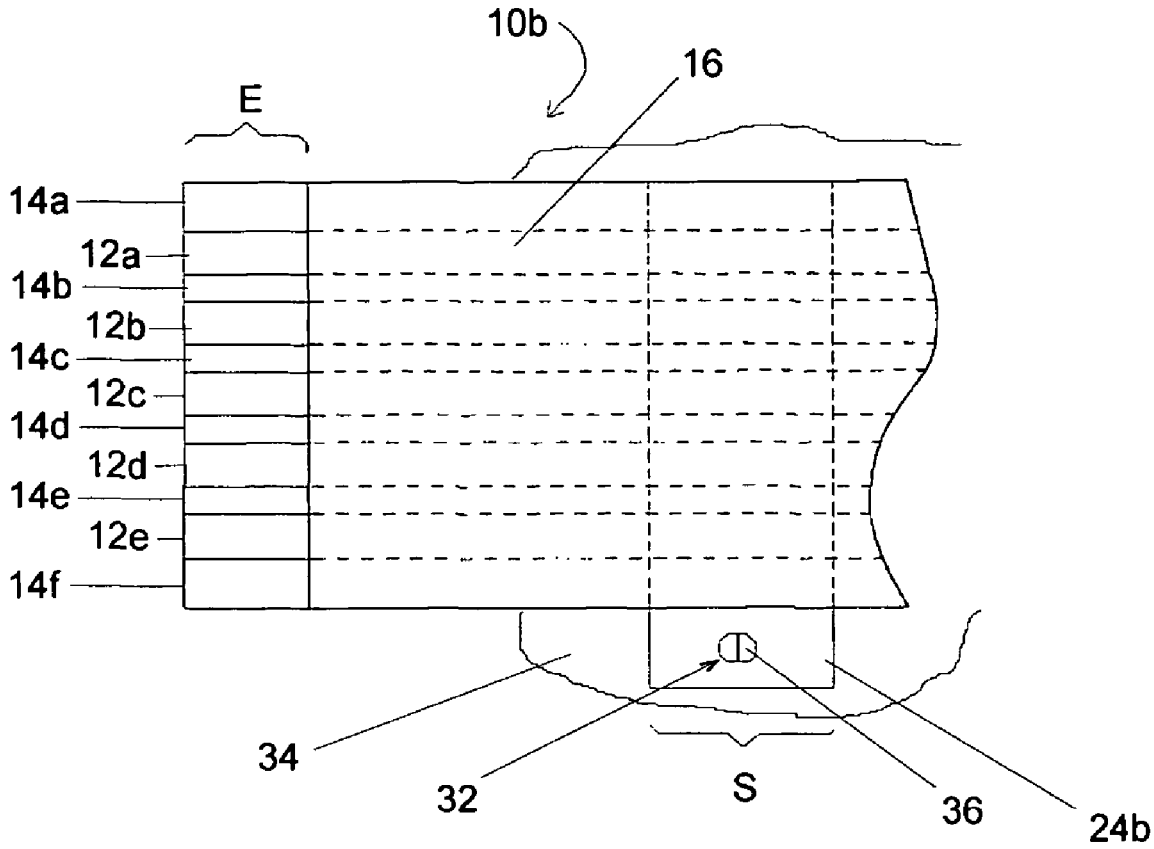
FIG. 5 illustrates another embodiment of a flat flexible cable in plan view.

According to another aspect, shown in FIG. 5, the stiffening element 24*b* may be employed to provide strain relief for the flat flexible cable 10*b*. For example, the stiffening element 24*b* may provide localized reinforcement of the flat flexible cable 10*b*. The flat flexible cable 10*b* may be anchored to a stationary element 34. A load applied to a portion of the flat flexible cable 10*b* may not be transmitted across the anchored region to a portion of the flat flexible cable 10*b* on the other side of the anchored region. According to one embodiment, the flat flexible cable 10*b* may be anchored by providing a hole 32 defined through the stiffening element 24*b* and mechanically fastening the flat flexible cable 10*b* to the stationary element 34, for example using a screw 36, rivet, or similar fastener. The reinforcement provided by the stiffening element 24*b* may resist pull-out under an applied load. Consistent with the embodiment illustrated in FIG. 5 a portion of the stiffening element 24*b* may extend beyond an edge of the flat flexible cable 10*b*. The portion of the stiffening element 24*b* extending beyond the edge of the flat flexible cable 10*b* may be anchored to a stationary structure 34. Alternatively, the stiffening element of the flat flexible cable may be anchored to a stationary structure by a mechanical fastener, etc., extending through the flat flexible cable and the stiffening element. Consistent with such an embodiment, the stiffening element may, or may not, extend beyond the edge of the flat flexible cable.

According to one embodiment, the flat flexible cable 10 may be produced by laminating the top insulating layer 16, the conductive pathways 12*a–e* and the bottom insulating layer 18 together with the stiffening element 24 laminated at least partially between the bottom insulating layer 18 and the conductive pathways 12*a–e*. Lamination may be achieved by providing an adhesive layer 20 between the top insulating layer 16 and the conductive pathways 12*a–e*. Similarly, an adhesive layer 22 may be provided between the bottom insulating layer 18 and the conductive pathways 12*a–e*. An adhesive layer 26, 28 may also be provided on either side of the stiffening element 24. Consistent with such an embodiment, the insulating partitions 14*a–f* may be formed by adhesive layers 20 and 22 laminated in between the conductive pathways 12*a–e*. In the stiffened region S the insulating partitions 14*a–f* may be formed by the adhesive layers 20 and 26. Similarly, in the stiffened region S the adhesive layer 28 associated with the stiffening element 24 and the adhesive layer 22 may for a layer of adhesive 30 between the lower insulation element 18 and the stiffening element 24. The adhesive layers 20, 22, 26, and 28 may be any suitable adhesive. According to one embodiment, the adhesive layers 20, 22, 26, and 28 may be a thermoset adhesive, for example, a polyester adhesive. Various other adhesives, both thermoset and thermoplastic, may suitably be used to produce a flat flexible cable 10 herein.

In a related embodiment, the conductive pathways 12*a–e* may be provided on a support member, such a sheet or film of an insulating material. The top insulating layer 16 may be laminated to the conductive pathways 12*a–e* and the support member in the regions between the conductive pathways 12*a–e*. Lamination of the top insulating layer 16 to the support member in the regions in between the conductive pathways 12*a–e* may provide the insulating partitions 14*a–f*. Similarly, the bottom insulating layer 18 may be laminated to a bottom of the support member. The stiffening element 24 may be laminated between the support member and the bottom insulating layer 18, thereby integrating the stiffening element 24 into the flat flexible cable 10.

Therefore, consistent with the present disclosure, there is provided a flat flexible cable having an integrated stiffening element. The integrated stiffening element may resist peeling or other removal of the stiffening element from the remainder of the flat flexible cable. In one embodiment, the flat flexible cable may include a laminated structure including conductive pathways disposed between top and bottom insulating layers. The stiffening element may be laminated between the conductive pathways and one of the top and the bottom insulating layers. Suitable adhesives may be employed between the various layers of the laminated structure. According to varying embodiments, the stiffening element of the flat flexible cable may stiffen a region of the cable, provide a desired thickness to region of the cable, facilitate strain relief, etc.

The embodiments herein are susceptible to modification and variation without departing from the invention herein. Accordingly, the described embodiments should not be construed as limiting the invention as set forth in the appended claims.

What is claimed is:

1. A flat flexible cable comprising:

a first and second insulating layer having respective surfaces defining generally opposed exterior cable surfaces;

at least one conductive pathway disposed between, and directly coupled to, said first and second insulating layers; and a stiffening element directly coupled to said second insulating layer and said at least one conductive pathway, said stiffening element being permanently disposed between said at least one conductive pathway and said second insulating layer, and said at least one conductive pathway being permanently disposed between said first and second insulating layers to resist separation therefrom.

2. A flat flexible cable according to claim 1 wherein said stiffening element is oriented generally transverse to said conductive pathway.

3. A flat flexible cable according to claim 1 wherein said at least one conductive pathway and said second insulating layer extend beyond said first insulating layer, wherein at least a portion of said conductive pathway is exposed beyond said first insulating layer.

4. A flat flexible cable according to claim 3 wherein said stiffening element extends at least partially beyond said first insulating layer.

5. A flat flexible cable according to claim 1 comprising a first adhesive layer directly coupling said first insulating layer and said at least one conductive pathway and a second adhesive layer directly coupling said second insulating layer and said at least one conductive pathway.

6. A flat flexible cable according to claim 5 comprising a plurality of conductive pathways, at least one of said first and second adhesive layers at least partially disposed between adjacent conductive pathways, and electrically isolating adjacent ones of said conductive pathways.

7. A flat flexible cable according to claim 5 wherein at least one of said first or second adhesive layers comprise a thermoset adhesive.

8. A flat flexible cable according to claim 7 wherein said thermoset adhesive comprises a polyester adhesive.

9. A flat flexible cable according to claim 1 wherein said stiffening element is disposed adjacent an end of said flat flexible cable.

10. A flat flexible cable according to claim 1 wherein said stiffening element is disposed spaced from an end of said flat flexible cable.

11. A flat flexible cable according to claim 1 wherein said first insulating layer comprises a material selected from the group consisting of: polyester and polyamide.

12. A flat flexible cable according to claim 1 wherein said second insulating layer comprises a material selected from the group consisting of: polyester and polyamide.

13. A method of forming a flat flexible cable comprising:

providing at least one conductive pathway;

providing a first insulating layer having a first surface;

providing a second insulating layer having a second surface;

disposing a stiffening element at least partially between said second insulating layer and said at least one conductive pathway; and directly laminating said first insulating layer to a first side of said at least one conductive pathway and directly laminating said second insulating layer to a second side of said at least one conductive pathway to resist separation of said at least one conductive pathway from said first and second insulating layers, said first and second surfaces defining generally opposed exterior cable surfaces, and said stiffening element being directly laminated to said second insulating layer and said at least one conductive pathway to resist separation therefrom.

14. A method according to claim 13 wherein directly laminating said first insulating layer to said first side of said at least one conductive pathway comprises providing an adhesive at least partially between said first insulating layer and said first side of said at least one conductive pathway.

15. A method according to claim 13 wherein directly laminating said second insulating layer to said second side of said at least one conductive pathway comprises providing an adhesive at least partially between said second insulating layer and said second side of said at least one conductive pathway.

16. A method according to claim 13 comprising providing a first adhesive disposed at least partially between said stiffening element and said second insulating layer and providing a second adhesive disposed at least partially between said stiffening element and said at least one conductive pathway.

17. A method of providing strain relief comprising:

providing a flat flexible cable comprising at least one conductor directly coupled to a first and second insulating layer, each said insulating layer comprising a surface defining an exterior surface of said cable, said cable further comprising an integrated stiffening element; and securing said stiffening element to a structure a distance from a flat flexible cable connector electrically coupled to said flat flexible cable.

18. A method according to claim 17 wherein said integrated stiffening element is at least partially disposed between a second insulating layer and a conductive pathway of said flat flexible cable.

19. A method according to claim 17 wherein said securing said stiffening element comprises mechanically fastening said stiffening element to said structure.

20. A method according to claim 19 wherein said mechanically fastening said stiffening element comprises inserting a fastener through said stiffening element and engaging said fastener with said structure.

* * * * *